US011756760B2

(12) United States Patent
Schulz et al.

(10) Patent No.: US 11,756,760 B2
(45) Date of Patent: Sep. 12, 2023

(54) X-RAY TUBE HAVING AN INSULATION BODY WITH A POTTED BODY

(71) Applicant: incoatec GmbH, Geesthacht (DE)

(72) Inventors: Torben Schulz, Buechen (DE); Karl Hans, Lueneberg (DE); Jenss Schmidt-May, Wrist (DE); Moritz Schlie, Hamburg (DE)

(73) Assignee: incoatec GmbH, Geesthacht (DE)

( * ) Notice: Subject to any disclaimer, the term of this patent is extended or adjusted under 35 U.S.C. 154(b) by 0 days.

(21) Appl. No.: 17/820,399

(22) Filed: Aug. 17, 2022

(65) Prior Publication Data

US 2023/0062446 A1 Mar. 2, 2023

(30) Foreign Application Priority Data

Aug. 25, 2021 (DE) ..... 10 2021 209 350.7

(51) Int. Cl.
*H01J 35/12* (2006.01)
*H01J 35/16* (2006.01)

(52) U.S. Cl.
CPC ..... *H01J 35/13* (2019.05); *H01J 35/16* (2013.01)

(58) Field of Classification Search
CPC ..... H01J 35/13; H01J 35/16
See application file for complete search history.

(56) References Cited

U.S. PATENT DOCUMENTS 2,790,102 A 4/1957 Atlee
4,264,818 A * 4/1981 Petersen ..... H01J 35/13 378/141
5,535,255 A * 7/1996 Gabbay ..... H01J 35/13 378/141
5,737,387 A * 4/1998 Smither ..... H01J 35/106 378/131
10,529,528 B2 * 1/2020 Shimizu ..... H01J 35/105
10,714,300 B2 * 7/2020 Heinke ..... H01J 35/13
2009/0252298 A1 10/2009 Luthardt et al.
(Continued)

FOREIGN PATENT DOCUMENTS

DE 674415 C 4/1939
DE 10 2008 017 153 A1 11/2009
(Continued)

OTHER PUBLICATIONS

Varex Industrial, "OEG-92J Industrial X-Ray tube", Version 2021, Varex Imaging Corporation, Salt Lake City, USA, Mar. 2021, 1-6.

*Primary Examiner* — Chih-Cheng Kao
(74) *Attorney, Agent, or Firm* — Orbit IP

(57) ABSTRACT

An X-ray tube has a cathode housing having a radiation exit window, a cooled anode, a hot cathode, an insulation body, a supply line for coolant to the anode and a discharge line for coolant from the anode. The supply and discharge lines have a plurality of turns in the insulation body. The potted body has an inner and outer mold. The anode, the cathode housing and the potted body are fastened on the ceramic body. At least one plastic directing body aligns the hoses separated from the outer and inner mold. The potting space is filled with a plastic potting compound in a cured state so that the intermediate spaces between the turns on the one hand and the outer mold and the inner mold on the other hand are occupied by the plastic of the at least one directing body and/or the plastic of the potting compound.

29 Claims, 7 Drawing Sheets

(56) References Cited

U.S. PATENT DOCUMENTS

| | | | |
|---|---|---|---|
| 2010/0111265 | A1 | 5/2010 | Holm et al. |
| 2012/0076278 | A1 | 3/2012 | Astle et al. |

FOREIGN PATENT DOCUMENTS

| | | | |
|---|---|---|---|
| DE | 10 2017 217 181 | B3 | 10/2018 |
| GB | 2 018 019 | A | 10/1979 |
| JP | 2015-232 944 | A | 12/2015 |
| JP | 2015-232944 | A | 12/2015 |
| WO | 2008/148426 | A1 | 12/2008 |

* cited by examiner

X-RAY TUBE HAVING AN INSULATION BODY WITH A POTTED BODY

CROSS-REFERENCE TO RELATED APPLICATIONS

This application claims priority to German Patent Application No. 10 2021 209 350.7 filed Aug. 25, 2021, the entire contents of which are hereby incorporated in full by this reference.

DESCRIPTION

Field of the Invention

The invention relates to an X-ray tube, which comprises a cathode housing having a radiation exit window, a cooled anode, a cathode, in particular a hot cathode, an insulation body for electrical insulation of a high-voltage potential of the anode, a supply line for coolant to the anode and a discharge line for coolant from the anode, the supply line and the discharge line respectively comprising a plurality of turns in the insulation body.

Background of the Invention

Such an X-ray tube has been disclosed by WO 2008/148426 A1 (Reference [1]).

X-radiation is used in a wide variety of ways in instrumental analytics or for taking images of human and animal patients in medicine. The generation of X-radiation is generally carried out in an X-ray tube by emission of electrons from an electrically heated hot cathode and acceleration of the electrons in a vacuum through an electric field onto an anode at which Bremsstrahlung and characteristic X-radiation are released according to the anode target material used (for example tungsten, molybdenum or rhodium).

During the generation of X-radiation, only a small part, usually about 1%, of the energy used is converted into X-ray power. The remaining part of the energy used generates heat. In order to prevent melting of the anode, it is therefore usual to cool the anode. The cooling of the anode is generally carried out by means of a coolant which flows through the anode. The coolant is in this case fed through cooling channels inside the anode.

During operation, the anode is typically at a high-voltage potential. As a consequence of this, electrical insulation of the anode is necessary. The anode may be arranged on an electrically insulating insulation body. Coolant lines, by which the anode is supplied with the coolant, typically also extend through the insulation body. Since the coolant in the anode is also at high voltage, it is necessary to ensure that voltage sparkovers do not occur across the coolant column, for which purpose the length of the coolant column, the conductivity or dielectric strength of the coolant and the applied voltage must be selected suitably. Only coolants with low electrical conductivity, for example deionized water (DI water), are regularly used as coolants.

Reference [1], cited in the introduction, discloses a high-voltage X-ray tube which comprises a cathode and an anode as well as an anode insulation element. The anode insulation element is configured as a ceramic cone and comprises an opening for a high-voltage plug. An intermediate element is inserted between the anode insulation element and a high-voltage plug introduced into the opening for the high-voltage plug. An inlet channel and an outlet channel through which a cooling liquid, in particular a cooling oil, is fed to the anode extend in the intermediate element. The inlet and outlet channels may be configured spirally. boring and casting are proposed for the manufacture of line structures.

If the inlet and outlet channels are configured spirally, a longer insulation path can be provided in the cooling liquid. However, spiral line structures inside the intermediate body are difficult to implement in production. Reference [1] provides no further information about how, in particular, spiral inlet and outlet lines are intended to be manufactured in the intermediate body.

Imprecise placement of the supply line and the discharge line in an insulation body, in particular an insufficient spacing of turns with respect to one another or with respect to an inner wall or outer wall of the insulation body, may lead to voltage flashovers and damage of the X-ray tube.

DE 10 2017 217 181 B3 (Reference [2]) and U.S. Pat. No. 10,714,300 B2 (Reference [3]) have disclosed a stationary anode for an X-ray generator. The stationary anode comprises an anode base body. There are spirally configured cooling sections, through which a cooling fluid for cooling the anode flows, in the anode base body.

The anode base body can be cooled better by the spirally configured cooling sections. However, the form which an insulation body for electrical insulation of the anode base body could take, and how an inlet channel and an outlet channel for the cooling fluid could be configured, are not discussed in detail.

A further X-ray tube has been disclosed by the X-ray tubes of the series OEG 9X from Varex Imaging Corporation, Salt Lake City, Utah 84104, USA (previously Varian Medical Systems), cf. the company document "OEG-92J Industrial X-Ray Tube", Version 2021 (Reference [4]). An X-ray tube of this series essentially comprises an anode at a high-voltage potential, which is applied on an annular glass element that is double U-shaped in cross section. The lower side of the glass element, facing away from the anode, is followed by an oil-filled hollow body. A coolant line leads in the oil-filled hollow body from a rear part of the X-ray tube through the glass element to the anode and back to the rear part of the X-ray tube. The coolant line extends in the rear part of the X-ray tube with coils around a high-voltage terminal. The coils bear axially on one another and radially outward on a plastic wall.

The coils maintain a certain mobility in the oil, which may promote voltage sparkovers. The coils bearing on one another furthermore have a rather low breakdown strength. A comparatively large length of the coolant line is needed in order to avoid voltage sparkovers, and this design correspondingly has a relatively large length. Furthermore, even minor leakage of the hollow body of the X-ray tube can lead to oil emerging and the rest of the X-ray tube and the surroundings being contaminated. These contaminations with oil can often be removed only with difficulty.

DE 10 2008 017 153 A1 (Reference [5]) discloses a cooled radiation source. The source comprises an x-ray protection housing filled with a cooling liquid. In the interior of the x-ray protection housing, there is located a radiation generation tube with a cathode and an anode. At the radiation protection housing, there is formed a flow channel filled with a cooling medium. With the flow channel, the interior of the radiation protection housing can be cooled. The cooling medium is supplied to and discharged from the flow channel via a feed line and a discharge line.

US 2012/0076278 A1 (Reference [6]) describes a cooled x-ray tube. The x-ray tube comprises a housing, a cathode assembly attached to the housing and including a cathode, a stator assembly attached to the housing and including a rotating anode, and an x-ray window attached to a window frame of the housing. In the housing and in the stator assembly, liquid cooling channels are formed. Via connections at the housing and the stator assembly, a coolant can be supplied to and discharged from the liquid cooling channels. With the coolant, the housing and the stator assembly can be cooled.

JP 2015-232 944 A (Reference [7]) discloses an x-ray tube device capable of preventing a vacuum envelope from being broken. The x-ray tube device comprises an x-ray tube, a stress relaxation film and a mold member. The x-ray tube comprises a cathode, an anode and the vacuum envelope. The film is adhered to the outer face of the vacuum envelope. The mold member covers the vacuum envelope and the film entirely and is glued to them. With the stress relaxation film, the stress acting from the outside of the vacuum envelope can be reduced.

SUMMARY OF THE INVENTION

Object of the Invention

The object of the present invention is to provide an X-ray tube which is easy to manufacture and with which a high electrical breakdown strength and a compact structure can be achieved.

DESCRIPTION OF THE INVENTION

This object is achieved according to the invention by an X-ray tube of the type mentioned in the introduction, wherein the insulation body comprises a ceramic body and a potted body, the anode and the cathode housing being fastened on the ceramic body and the potted body being fastened on the ceramic body, wherein the potted body comprises an inner mold and, at least temporarily during the production of the X-ray tube, an outer mold, wherein the supply line and the discharge line are respectively configured with a hose, which forms the plurality of turns, in a potting space between the outer mold and the inner mold, wherein at least one plastic directing body, by which the hoses are aligned in the potting space, is arranged in the potting space so that the turns of the hoses are respectively separated from the outer mold and the inner mold, and wherein the potting space is filled with a plastic potting compound in a cured state so that the intermediate spaces between the turns on the one hand and the outer mold and the inner mold on the other hand are occupied by the plastic of the at least one directing body and/or the plastic of the potting compound.

The present invention proposes to use at least one plastic directing body in order to arrange the hoses with the plurality of turns in the potting space. The at least one directing body allows defined and precise arrangement of the hoses in the potting space, particularly during the potting of the potting compound and until the potting compound is cured; the defined and precise arrangement also continues to be maintained thereafter.

The directing body (auxiliary body) guides and stabilizes the hoses in the potting space. With the at least one directing body, the hoses can be positioned reliably and straightforwardly in such a way that the hoses do not directly touch either the inner mold or the outer mold. In this way, flashovers from the hoses, or the coolant contained therein, onto the inner and outer molds (or the outer side of the filled potting space) can be prevented and damage of the X-ray tube can therefore be avoided during operation of the X-ray tube.

The directing bodies furthermore allow defined, for example uniform, arrangement of the hoses, particularly in the radial direction and/or axial direction.

Because the hoses can be positioned precisely in the potted body, that is to say the positioning tolerances are small, only these small positioning tolerances need to be taken into account for the configuration of the X-ray tube in respect of the high voltage (and associated breakdown strength) desired during operation. In particular, a minimum spacing of hose sections can be ensured by means of the directing bodies. In other words, smaller safety margins are needed for the spacing of the hoses from the inner and outer molds, or else preferably between the turns of the hoses. In this way, the space requirement of the multiply wound hoses can be reduced and the X-ray tube can be constructed even more compactly, and in particular can be constructed more compactly in the radial and/or axial direction, depending on the design.

The supply line and the discharge line generally each run substantially helically (in the shape of a helix) around a tube axis of the X-ray tube and in this case form a double helix structure (i.e., the individual turns can alternately be assigned to the supply line and the discharge line); the double helix may in this case be configured to be cylindrical (straight) or conical (tapering). Preferably, the supply line and the discharge line run in the same (symmetrical) way around the tube axis, in particular with the same (local) pitch and the same (local) radius, the supply line and the discharge line being arranged rotated with respect to one another by 180° around the tube axis.

The plastic potting compound is introduced in the liquid state into the potting space. For this purpose, the X-ray tube may for example be mounted in such a way that the anode faces toward the supporting surface where an opening leading into the potting space points in the opposite direction upward. The liquid potting compound can be distributed uniformly in the potting space (between the inner mold and the outer mold) and without forming gaps or cavities. The potting compound may in particular also be distributed between the hoses which are held in position by the at least one directing body.

The potting compound is then cured, which may for example be carried out by waiting and/or heat treatment, depending on the material system, and it maintains its shape in the cured state. If desired, the outer mold may be removed from the rest of the potted body (in particular from the cured potting compound of the filled potting space) when the potting compound is in the cured state. In the cured state, the plastic potting compound—optionally together with the plastic material of the at least one directing body—separates the hoses permanently from the walls of the inner mold and of the outer mold (or the outer side of the filled potting space) and preferably also separates the hoses from one another so that contact of the hoses with the walls, and preferably also with one another, is no longer possible. In this way, the risk of flashover between the hoses and the walls during operation of the X-ray tube can be minimized; with potting compound between the hoses, the potting compound may furthermore contribute to minimizing the risk of voltage flashovers between the hoses, or the neighboring turns, so that the thickness of the hose walls may optionally be reduced or the dielectric strength of the hose material becomes less relevant. Furthermore, the ceramic body can be connected tightly and without gaps or cavities to the potted body; typically, the potted body is already mechanically fastened well on the ceramic body by the potting of the potted body onto the ceramic body.

As a plastic, the potting compound has a good dielectric strength so that flashovers and therefore damage of the components of the X-ray tube can be avoided with a compact build. By the use of the potting compound, it is possible to obviate an oil-filled hollow body with an electrically insulating oil, through which the hoses are fed. The cured potting compound may still be flexible ("soft") to a certain extent, but it is no longer capable of flowing, and in particular is no longer fluid.

The anode may be applied in a straightforward way and vacuum-tightly on the ceramic body, for example by soldering onto a metallized surface of the ceramic body, or by heat- and vacuum-resistant adhesive bonding onto the ceramic body. Owing to the configuration of the ceramic body, the creepage path can furthermore be adapted both on the side of the ceramic body which faces toward the anode and on the side of the ceramic body which faces toward the potted body, and the breakdown strength may thereby be improved. The ceramic body may, for example, be made from $Al_2O_3$ or $ZrO_2$.

Particularly for laying in the potting space, the hoses have a certain pliability or flexibility, alignment of the hoses in the potting space being carried out by means of the at least one directing body. The hoses in this case preferably have a minimum degree of intrinsic stiffness, due to which the respective hose has a basic geometry that is adapted to the desired hose geometry in the X-ray tube. Furthermore, the inner walls of the hoses may be created in such a way that they have a low roughness and therefore present a low flow resistance to the coolant flowing through the hoses. In this way, efficient supply and discharge of coolant to and from the anode can be set up. Likewise, for this purpose the inner walls of the hose may additionally be coated, particularly in order to adjust the surface tension between the coolant and the hose.

In general, it is readily possible to configure the hoses so that they are liquid-tight. In this way, it is possible to avoid liquid leaks in the insulation body, which could for example lead to undesired flashovers in the insulation body and could therefore damage the components of the X-ray tube.

For example, deionized water (DI water), single-distilled water or multiple-distilled water may be used as the coolant. Water-based coolants are preferred because of their high specific heat capacity; besides water-based coolants, however, it is also possible to use other coolants, for example an oil, in particular silicone oil. Preferably, the coolant has a low electrical conductivity of less than 1 μS/cm. Since the length of the coolant column required, and therefore the length of the hoses filled with coolant, is dependent inter alia on the conductivity of the coolant, by suitable selection of a coolant having a low conductivity it is possible to reduce the length of the hoses and the space requirement of the X-ray tube can therefore be reduced.

The X-ray tube according to the invention is typically set with the cathode grounded (notwithstanding the heating current of the cathode) and the anode at a (positive) high-voltage potential. In the scope of the invention, it is also possible to set the cathode at a (negative) high-voltage potential, if so desired.

Preferred Embodiments of the Invention

According to one preferred embodiment of the X-ray tube according to the invention, with the at least one directing body, the hoses are furthermore aligned in the potting space so that the turns of the hoses are also separated from one another, and the potting space is furthermore filled with the potting compound so that the intermediate spaces between the turns are also occupied by the plastic of the at least one directing body and/or the plastic of the potting compound. By the at least one directing body, the turns of the hoses can be separated from one another reliably and accurately in the potting space, particularly in respect of the axial direction. The spacing between the turns of the hoses can be adjusted precisely in such a way that during operation of the X-ray tube with a given high voltage, no flashovers between the turns of the hoses or the coolant contained therein, and therefore no damage of the X-ray tube, take place. By the precise alignment, the space in the X-ray tube or rather in its insulation body can be used efficiently and the space requirement of the hoses can therefore be kept small. The X-ray tube can thus be configured even more compactly. The hoses can be held reliably in their position and separated from one another by the directing bodies during the filling of the mold by the potting compound. During the filling of the mold with the potting compound in the liquid state, the potting compound can be distributed uniformly in the intermediate spaces of the turns and without forming gaps or cavities.

Another preferred embodiment is one wherein the ceramic body has a circumferential indentation between the cathode housing and the anode on a front side facing toward the anode, and wherein the ceramic body has a central recess on a rear side of the ceramic body facing toward the potted body. The circumferential indentation increases the distance between the anode and the cathode housing (which is grounded) on the front side of the ceramic body, so that a long creepage path is set up. The central recess increases the distance between structures connected to the anode, which lead through the ceramic body (typically a high-voltage feed-through and usually also tubelets for the cooling liquid), and the outer side of the insulation body (which is generally grounded) on the rear side of the ceramic body, so that a long creepage path is set up in between the ceramic body and the potted body. In longitudinal section, the ceramic body may then be configured approximately in a W shape; the ceramic body is then also referred to as crown-shaped because of the plurality of indentations. The circumferential indentation is (on each side in longitudinal section) typically V-shaped or U-shaped, and the central recess is likewise typically (oppositely) V-shaped or U-shaped in longitudinal section along the tube axis. It should be noted that in many embodiments only the central recess is provided, and in other embodiments both the circumferential indentation and the central recess are provided.

In one preferred refinement of this embodiment, the hoses are arranged partially in a region of the central recess of the ceramic body, in particular with in each case at least one half-turn of the hoses and/or at least 10% of the length of the hoses being arranged in the central recess of the ceramic body. In this way, the space of the recess can be used efficiently and the hoses can be connected closer to the anode (for instance to tubelets/tube sockets, which protrude through the ceramic body) and the length of the hoses and therefore the distance for the drop of the high voltage of the anode can thus be extended. The recess typically extends in the direction of the tube axis over at least 50% of the axial extent of the ceramic body, into the latter. The recess may be conically shaped, preferably with the largest radius of the recess on the rear side of the ceramic body extending over at least ⅔ of the outer radius of the ceramic body on its rear side.

Furthermore, preferred is an embodiment in which the inner mold is configured as a bush for a high-voltage plug for connection to the anode. By means of the bush and the high-voltage plug, the connection of the anode to the high voltage can be carried out in a straightforward, in particular reversible way. By the bush, which is made from electrically insulating material (usually a plastic), a required creepage path may be made available in order to prevent flashovers due to the applied high voltage from a terminal pole (usually on the base of the bush) onto the grounded parts of the X-ray tube (for instance the coolant terminals) or the cable shield. Furthermore, the high-voltage terminal of the high-voltage plug (which in the connected state protrudes into the bush and makes contact with the terminal pole) can be protected by the bush against inadvertent touching. The bush is typically located on the side of the insulation body facing away from the anode, radially centrally in the potted body, and the supply line and the discharge line preferably also extend around the bush so that a particularly compact and electrostatically stable coaxial buildup of the high-voltage potentials can be achieved.

Likewise preferred is an alternative embodiment wherein the inner mold is configured as a cable which comprises an insulating sheath and a core, extending in the sheath, to which the anode is connected. This embodiment is particularly economical and can achieve an even more compact structure, particularly in the radial direction. The cable may be potted directly with the potting compound.

Particularly preferred is an embodiment in which the at least one directing body and the potting compound consist of the same plastic. By the use of the same plastic for the directing body or bodies and the potting compound, a particularly good bond is achieved between the directing body and the potting compound. A substantially monolithic potted body having hoses for the coolant running internally in a defined way is obtained. Distortions of field lines at the interface between directing bodies and the potting compound are minimized, and creepage currents at these interfaces are likewise minimized. The structure of the potted body is therefore much less susceptible to voltage flashovers. By the use of the same plastics for the directing body or bodies and the potting compound, the structure of the X-ray tube can be made even more compact because of the improved breakdown strength.

In one preferred refinement of this embodiment, the plastic of the potting compound comprises a silicone or an epoxy resin or a polyurethane. These plastics have proven themselves particularly well in practice. The plastics are favorably obtainable, can be easily potted in the liquid state, are curable and have good electrical insulation properties. Furthermore, these materials are subject to only minor aging effects (particularly in comparison with insulation oil).

According to one particularly preferred embodiment, a plurality of directing bodies is arranged in the potting space, in particular with the directing bodies in each case being arranged clamped between the inner mold and the outer mold and/or between the hoses on the one hand and the inner mold or the outer mold on the other hand.

By the use of a plurality of directing bodies, the hoses can be aligned even better in the potting space and can be held in position particularly easily. By clamping the directing bodies on the hoses and the molds, secure holding of the directing bodies is possible in a straightforward way, in particular for the potting process. As an alternative, it is also possible to support the directing bodies in a clamping fashion on one another and at least on the outer mold. In general, the directing bodies bear on the hoses in order to keep them aligned (during the potting process).

Advantageous is a refinement of this embodiment in which the directing bodies are arranged at angular positions in a respective section plane perpendicular to a tube axis of the X-ray tube, the angular positions forming a rotationally symmetrical arrangement with respect to the tube axis. By the rotationally symmetrical arrangement of the directing bodies, they can act uniformly on the hoses from a plurality of directions so that the hoses receive a radial force (clamping force) and/or are radially aligned approximately uniformly over the circumference of their turns. In this way, roundness defects of the turns can be minimized and the hoses can be supported particularly stably by the directing bodies.

Also advantageous is a further development of this refinement wherein N directing bodies support the hoses toward the inner mold and N directing bodies support the hoses toward the outer mold, and the rotationally symmetrical arrangement of the angular positions has N-fold symmetry, where N is a natural number with $N \geq 2$. This distribution of the directing bodies has proven itself particularly well in practice. The hoses can in this way be positioned particularly accurately and held in position well in the potting space.

It is likewise advantageous in this case for the N directing bodies which support the hoses toward the inner mold and the N directing bodies which support the hoses toward the outer mold to be arranged with respect to the tube axis in a respective section plane at identical angular positions, or at angular positions offset by $360°/(2*N)$ with respect to one another. Positioning the directing bodies at identical angular positions allows particularly straightforward clamping of a respective hose section between the opposing directing bodies; in this way, very accurate alignment of the hoses can be carried out, in particular with minimized compression of the turns. In some embodiments, with identical angular positions of directing bodies, the directing bodies may also support one another. By positioning the directing bodies at different angular positions, the alignment of the hoses in the circumferential direction may be carried out at a particularly large number of points, so that the alignment of the hoses can be made particularly precise, especially in the axial direction. It should be noted that the N directing bodies which support the hoses toward the inner mold and the N directing bodies which support the hoses toward the outer mold, with arrangement at identical angular positions, may be configured in one piece (for instance as a perforated plate) or in a plurality of pieces (for instance as opposing grooved bars).

Also preferred is an embodiment in which one or more directing bodies of the at least one directing body are configured as a perforated plate comprising a plate and a plurality of holes in the plate, through which the hoses are guided, in particular, with a respective perforated plate being arranged clamped between the inner mold and the outer mold. Such perforated plates are straightforward to manufacture and can be positioned straightforwardly in the mold. The hoses are guided through the holes of the perforated plate (typically before the perforated plate and the hoses are arranged between the outer mold and the inner mold). Uniform arrangement of the hoses is readily possible due to the predetermined structure of the perforated plate. The spacing between the hoses can be adjusted by means of the spacings of the individual holes with respect to one another. Likewise, by means of the spacing of the holes with respect to the lateral edges of the perforated plate, the spacing of the hoses with respect to the inner and outer molds may be adjusted when, in the clamped state, the lateral edges lie against the inner and outer mold.

Advantageous is a further embodiment wherein one or more directing bodies of the at least one directing body are configured as a grooved bar comprising a bar and a plurality of grooves, in particular semicircular grooves, into which the hoses are placed, in particular, with a respective grooved bar being arranged clamped between the hoses on the one hand and the inner mold or the outer mold on the other hand. Such grooved bars are particularly straightforward to manufacture. The grooved bars can be arranged straightforwardly and flexibly on the inner mold and/or the outer mold. The hoses are placed into the grooves of the grooved bars and are thereby aligned. By clamping the grooved bars between the hoses and one of the molds, the grooved bars can be fixed in a straightforward way for the potting process.

In one advantageous refinement of this embodiment, grooved bars which support hoses toward the inner mold and grooved bars which support hoses toward the outer mold are respectively arranged lying opposite one another pairwise. In this way, the hoses can be held precisely in position in a straightforward way, in particular with the hoses being clamped between the opposing grooved bars. With a corresponding size of the grooved bars, the grooved bars may also support one another.

Likewise advantageous is an embodiment in which the turns of the hoses are wound around a tube axis and are sequenced along a tube axis. The hoses can be arranged in a straightforward manner in this way. The turns of the hoses may be arranged in a space-saving fashion.

Also advantageous is a refinement of this embodiment in which the turns have a constant radius with respect to the tube axis, in particular with the outer mold and the inner mold being configured substantially in the form of the lateral surface of a cylinder and coaxially with respect to the tube axis, so that the turns have a constant radial spacing with respect to the outer mold and furthermore the turns have a constant radial spacing with respect to the inner mold. This can in practice be set up particularly straightforwardly and precisely.

Particularly advantageous is a further development of this refinement in which the turns have a constant spacing with respect to one another in the axial direction. This can also be set up straightforwardly and precisely in practice. The constant (uniform) spacings of the turns of the hoses, with at the same time a constant radius of the turns, distribute the voltage drop over the length of the coolant column uniformly over all the turns; the potential difference between neighboring turns (respectively at the same angular positions) is the same for all the turns. In this way, optimal use of space can be achieved in the potted body with a desired breakdown strength between the turns of the hoses.

Furthermore advantageous is an alternative refinement of the embodiment above wherein the turns have a radius with respect to the tube axis which increases away from the anode, in particular with the outer mold and the inner mold being configured substantially in the form of the lateral surface of a cylinder and coaxially with respect to the tube axis, so that the turns have a radial spacing with respect to the outer mold which decreases away from the anode and furthermore the turns have a radial spacing with respect to the inner mold which increases away from the anode. In the hose sections which are close to the anode with respect to the coolant path, a relatively high potential still prevails. Because of the radius of the turns which is still small close to the anode, a larger radial spacing with respect to the outer mold (which typically has contact with the ground) is maintained here so that a better breakdown strength is achieved in this region. Conversely, in the hose sections which are far away from the anode with respect to the coolant path, only a low potential (which is closer to the ground) still prevails. Because of the large radius of the turns far away from the anode, a larger radial spacing with respect to the inner mold (in the interior of which a conductor carrying the high-voltage potential is arranged during operation) is maintained here, so that a better breakdown strength is also achieved in this region. In this way, the overall size of the X-ray tube can be used optimally.

Also advantageous is a further development of this refinement wherein the turns have a constant axial spacing with respect to one another or an axial spacing with respect to one another which increases away from the anode. A constant axial spacing of the turns with respect to one another can be set up particularly straightforwardly. By an axial spacing of the turns with respect to one another which increases away from the anode, with at the same time an increasing radius of the turns, the breakdown strength can be improved even more. By the radius of the turns increasing away from the anode, the voltage drop across the coolant per turn increases away from the anode. The potential difference between neighboring turns (respectively at the same angular positions) therefore increases away from the anode, which increases the risk of voltage flashovers. By the axial spacing increasing away from the anode, this can be compensated for (at least partially) in respect of the breakdown strength. Preferably, the axial spacings of the turns vary proportionally to the radii of the turns; in this way, an approximately equal voltage drop per axial spacing everywhere (or an equal field strength everywhere) is achieved in the potted body between the turns, insofar as it is due to the linear decrease of the high voltage of the anode over the length of the hoses in the coolant. The overall space in the X-ray tube is used optimally.

Preferred is an embodiment of the X-ray tube according to the invention wherein after the production of the X-ray tube, the outer mold remains on the rest of the potted body. In other words, the outer mold needed during the potting is not removed after the potting but remains part of the X-ray tube during its operation. This is particularly straightforward. The outer mold may furthermore mechanically stabilize the X-ray tube during operation. If necessary, the outer mold may be wound with an electrically highly conductive and/or highly X-radiation absorbing material, for example a lead foil, in order to ensure grounding and radiation protection.

According to an alternative embodiment, after the production of the X-ray tube, the outer mold is removed from the rest of the potted body. In other words, the mold needed during the potting is arranged on the ceramic body only during the potting process and is no longer part of the X-ray tube during its operation. In this way, it is possible to use an outer mold for the production of a multiplicity of X-ray tubes. If necessary, the rest of the potted body may be wound with an electrically highly conductive and/or highly X-radiation absorbing material, for example a lead foil, in order to ensure grounding and radiation protection.

Furthermore, within the scope of the present invention is also a method for producing an X-ray tube as described above, having the steps:

a) in order to set up the potting space, the outer mold is arranged in a sealing manner on a rear side of the ceramic body facing away from the anode and the inner mold is arranged in front of the rear side of the ceramic body, and the at least one plastic directing body and the hoses are arranged in the potting space between the inner mold and the outer mold, with the at least one directing body aligning the hoses in the potting space in such a way that the turns of the hoses are respectively separated from the outer mold and the inner mold, and preferably the turns are also separated from one another;

b) the potting space is filled with the plastic potting compound in a liquid state so that the intermediate spaces between the turns on the one hand and the outer mold and the inner mold on the other hand, and preferably also the intermediate spaces between the turns, are occupied by the plastic of the at least one directing body and/or the plastic of the potting compound;

c) the plastic potting compound is cured.

With this production method, an X-ray tube with which a high electrical breakdown strength and a compact structure are achievable can be manufactured in a straightforward way. The sealed potting space can readily be filled cleanly with the potting compound in the liquid state, and the potting compound automatically and fully fills the potting space provided, in particular without gaps and cavities. The directing bodies and hoses are enclosed by the potting compound, and a potted body consisting of solid material is obtained, which can provide a good breakdown strength. By the at least one directing body, the hoses can be arranged particularly straightforwardly and precisely in the potting space, in which case desired spacings with respect to the inner mold and the outer mold may be adjusted, in particular, with small tolerances. Furthermore, the hoses can be arranged by the at least one directing body with desired spacings of the turns with respect to one another, in particular, with small tolerances. The at least one directing body holds the hoses stably and in position during the filling of the potting space with the potting compound in the liquid state. After the curing of the potting compound, the hoses continue to remain in the desired precisely adjusted positions, while continuing to be held by the directing bodies and then also by the cured potting compound.

The individual steps of step a) may in principle take place in any desired order. Typically, the at least one directing body is mechanically clamped in the scope of step a) with hoses bearing on the directing body, typically between the inner and outer molds (especially in the case of a perforated plate), or between the hoses on the one hand and the inner or outer mold on the other hand (especially in the case of grooved bars).

In order to achieve better bonding between the directing body and the potting compound, the plastic of the directing body and the plastic of the potting compound may be the same plastic. If the plastic of the (at least one) directing body and the plastic of the potting compound are the same plastic, the (at least one) directing body is typically manufactured and cured beforehand, before it is inserted into the potting space.

It should be noted that at the start of step a), the tube head (in particular the cathode housing and the anode) has typically already been arranged on the ceramic body. With the method according to the invention, an X-ray tube according to the invention as described above, including the embodiments described above, can be produced.

According to one preferred variant of the method according to the invention, the outer mold remains on the rest of the potted body after step c); correspondingly, in this variant an X-ray tube in which the outer mold remains on the rest of the potted body after the production of the X-ray tube is produced. This is particularly straightforward to implement; in particular, no mold release step for the outer mold is needed after the molding.

In another variant of the method according to the invention, the method furthermore comprises a step d) the outer mold is removed from the rest of the potted body; correspondingly, in this variant an X-ray tube in which the outer mold is removed from the rest of the potted body after the production of the X-ray tube is produced. The outer mold may then be used in the production of a multiplicity of X-ray tubes; as an alternative, however, the outer mold may also be used only once, if so desired, particularly if the mold release requires destruction of the outer mold.

Further advantages of the invention may be found from the description and the drawing. Likewise, the features referred to above and those yet to be mentioned below may respectively be used according to the invention independently or jointly in any desired combinations. The embodiments shown and described are not to be understood as an exhaustive list, but rather have an exemplary nature for the presentation of the invention.

DETAILED DESCRIPTION OF THE PREFERRED EMBODIMENTS

Figure 1:
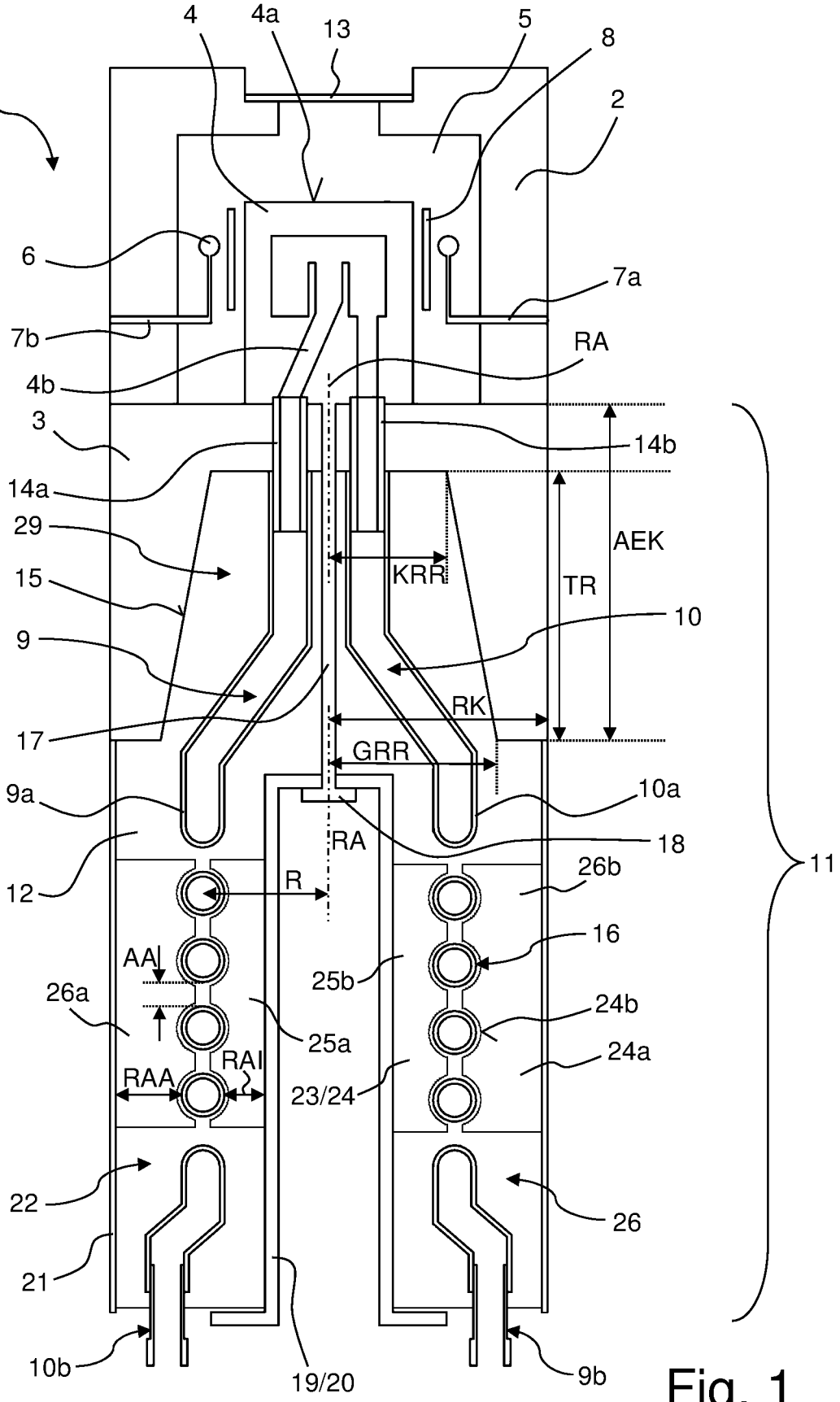
FIG. 1 shows a schematic longitudinal section of a first embodiment of an X-ray tube according to the invention, having grooved bars and turns of the hoses with a uniform radius.

FIG. 1 shows a first embodiment of an X-ray tube 1 according to the invention in a schematic longitudinal section. The X-ray tube 1 extends along a tube axis RA.

The X-ray tube 1 comprises a cathode housing 2 which is fastened vacuum-tightly on a ceramic body 3, for example by soldering. An anode 4 (here having an approximately cylindrical anode body) which is likewise fastened vacuum-tightly on the ceramic body 3, typically likewise by soldering, is furthermore arranged inside the cathode housing 2. The cathode housing 2, the ceramic body 3 and the anode 4 delimit an evacuated space 5.

Arranged in the evacuated space 5 there is a cathode, here a hot cathode 6, typically formed with electrical filaments. In the embodiment shown, the hot cathode 6 can receive an electrical current via a ground terminal 7*a* and a current terminal 7*b*, which are fed vacuum-tightly through the cathode housing 2. The electrical current is typically an AC current, preferably with a low voltage, usually with a maximum voltage amplitude of 24 V or less. With this electrical current (also referred to as a heating current), the hot cathode 6 can be brought to incandescence so that electrons emerge from the hot cathode 6.

During operation, the anode 4 is at a positive high-voltage potential (typically from 20 kV to 60 kV, in other applications possibly even more), relative to the hot cathode 6. During operation in the embodiment shown here, the hot cathode 6 is grounded, notwithstanding the heating current explained above. Electrons emerging from the hot cathode 6 are accelerated by the high voltage, under the effect of a grounded shield 8, from the hot cathode 6 onto the anode 4, here onto an upper side 4*a* of the anode 4. When they impinge on the anode 4, the electrons are decelerated so that X-radiation is generated in the form of Bremsstrahlung. Furthermore, electrons are ejected from the inner shells of the atoms of the material ("target") arranged on the upper side 4*a* of the anode 4. When electrons from the outer shells fill the inner shells of these atoms, X-radiation is emitted in the form of characteristic X-radiation. In general, a desired material is applied on the upper side 4*a* of the anode 4 in order to generate the X-radiation characteristic of this material. The X-radiation generated emerges from the X-ray tube 1 through a radiation exit window 13, here a beryllium window, and can be used for measurements, for example an X-ray fluorescence measurement on a sample, or for the recording of an X-ray image.

The electrons which are accelerated onto the anode 4 heat the anode 4, which consists of metal. In order to prevent melting of the anode 4, the anode 4 is cooled with a coolant. Formed in the X-ray tube 1 there is a supply line 9, which conducts the coolant to the anode 4, and furthermore a discharge line 10 which conducts the coolant back away from the anode 4. It should be noted that the supply line 9 and the discharge line 10 may also be connected the other way round to the coolant flow, if so desired.

The anode 4, which is at a high-voltage potential, must be electrically insulated. In particular, voltage flashovers onto the outer side of the X-ray tube 1 and other grounded structures must be prevented.

The electrical insulation of the anode 4 is carried out on the X-ray tube 1 essentially by an insulation body 11 and the evacuated space 5 set up in the cathode housing 2. According to the invention, this insulation body 11 comprises the ceramic body 3 made of ceramic material, on which the anode 4 and the cathode housing 2 are seated, and a potted body 12 which is fastened to the ceramic body 3 on the rear side. The ceramic body 3 consists of a vacuum-tight ceramic material, for example $Al_2O_3$. The potted body 12 consists to a substantial part of a plastic potting compound 32. The plastic of the potting compound 32 may, for example, be a silicone. The supply line 9 and the discharge line 10 are fed through the insulation body 11 to the anode 4. The insulation body 11 (and correspondingly also the respectively associated section of the ceramic body 3 and the housing body 12) is configured approximately in the shape of a circular cylinder on the outside and aligned along the tube axis RA.

It should be noted that the coolant is in contact with the high-voltage potential in the anode 4 and is grounded in the region of coolant connections 9*b*, 10*b*. Correspondingly, the high voltage drops in the coolant over the length of the supply line 9 and over the length of the discharge line 10. In order to prevent sparkovers of the high voltage, on the one hand a coolant having a low electrical conductivity or high dielectric strength is used, for example deionized water or a silicone oil. On the other hand, the X-ray tube 1 is designed in such a way that it allows a large length (path length) of the supply line 9 and the discharge line 10 in a compact space and furthermore ensures sufficient separation of structures that are at different electrical potentials.

In the design shown, two tubelets 14*a*, 14*b*, typically made of metal, lead through the ceramic body 3, to which at the upper end anode channels 4*b* for the coolant, which run within the anode 4, are connected and to which at the lower end hoses 9*a*, 10*a* are connected. It should be noted that in other designs, the coolant feed through the ceramic body 3 may also be configured differently, for example with coaxial tubelets or ceramic tubelets, or simple holes, into which plug connections (not represented) are inserted. The hoses 9*a*, 10*a* form the supply line 9 and the discharge line 10, insofar as they run within the potted body 12. The hoses 9*a*, 10*a* are made from a plastic material. In the potted body 12, the hoses 9*a*, 9*b* respectively form a plurality of turns 16 in a central section, which are arranged successively in the axial direction and form a double helix in this region (more on this below).

On its rear side facing away from the anode 4, the ceramic body 3 forms a central recess 15, which is configured conically here. In the axial direction (along the tube axis RA), the recess 15 extends over a depth TR into the ceramic body 3, which in total has an axial extent AEK. In the embodiment shown, TR=0.8*AEK approximately applies; in general, preferably, TR 0.5*AEK or even TR 0.75*AEK. In the radial direction (perpendicularly to the tube axis RA), the recess 15 extends at its widest point on the rear side of the ceramic body 3 with a maximum radius GRR, and at its end near the anode at its narrowest point with a minimum radius KRR. The ceramic body 3 has an outer radius RK in the region of its rear side; it should be noted that in the embodiment shown, the ceramic body 3 has a uniform outer radius. In the embodiment shown, GRR=0.75*RK approximately applies; in general, preferably, GRR 0.5*RK or even GRR 0.67*RK. Furthermore, in the embodiment shown KRR=0.53*RK approximately applies; in general, preferably, KRR 0.33*RK or even KRR 0.40*RK.

By the recess 15 in the ceramic body 3, the hoses 9*a*, 10*a* can be brought axially close to the anode 4, and the depth TR of the recess 15 can at least partially be used to make the high voltage drop across the coolant in the hoses 9*a*, 10*a*. The tubelets 14*a*, 14*b*, by which the anode channels 4*b* are connected to the hoses 9*a*, 10*a*, can be configured to be comparatively short. A considerable hose length, usually at least 10% of the respective overall hose length or even a hose length corresponding to at least a half-turn 16 (i.e., at least R*pi, with R: radius of the turns 16), can be accommodated in the region of the recess 15. The recess 15 furthermore leads to a comparatively long creepage path from the tubelets 14*a*, 14*b* to the radial outer side of the ceramic body 3 along the interface with the potted body 12, which, in particular, is much longer than the radius RK of the ceramic body 3.

A metal contacting element 17, which connects the anode 4 to a terminal pole 18, is also fed through the ceramic body 3. The contacting element 17 furthermore extends centrally in the X-ray tube 1 through the potted body 12 and, in the embodiment shown, leads into a bush 19 for a high-voltage plug (the latter is not represented) with which the high voltage for the anode 4 can be connected to the terminal pole 18 in the bush 19. The bush is made from an electrically insulating material, for example a plastic.

Here, the bush 19 at the same time forms an inner mold 20 for the potted body 12. The bush 19 is configured approximately cylindrically and is aligned with the tube axis RA.

The potted body 12 furthermore comprises an outer mold 21, which is configured here as a cylinder tube which may for example be made from metal or plastic. The inner mold 20, the outer mold 21 and the ceramic body 3 delimit a potting space 22. In particular, the hoses 9*a*, 10*a* run within this potting space 22.

The hoses 9*a*, 10*a* are aligned in the potting space 22 with the aid of directing bodies 23. The directing bodies 23 consist of plastic. Typically, the directing bodies 23 are arranged clamped in the potting space 22. In the embodiment shown, the directing bodies 23 are configured as grooved bars 24. The grooved bars 24 respectively comprise a bar 24*a* on which a plurality of grooves 24*b*, here semicircular grooves, are formed. A turn 16 of a hose 9*a*, 10*a* is placed into each groove 24*b*. In the embodiment shown, radially inner grooved bars 25*a*, 25*b* and radially outer grooved bars 26*a*, 26*b*, between which the turns 16 of the hoses 9*a*, 10*a* are clamped, respectively face one another. The grooved bars 24 are correspondingly clamped respectively between one of the molds 20, 21 and the hoses 9*a*, 10*a*.

By the directing bodies 23, the turns 16 of the hoses 9*a*, 10*a* are aligned with a high accuracy. In this case, both the spacing of the individual turns 16 radially inward with respect to the bush 19/inner mold 20 (RAI), and radially outward with respect to the outer mold 21 (RAA), and in the axial direction with respect to one another (AA) are set. In this case, in the embodiment shown, in the region of the turns 16 it is ensured that the neighboring turns 16 of the various hoses 9*a*, 10*a*, and furthermore the hoses 9*a*, 10*a* and the inner mold 20, and lastly the hoses 9*a*, 10*a* and the outer mold 21, do not touch (i.e., AA>0, RAI>0, RAI>0). In the embodiment shown, for all the turns 16 the radial spacing RAI inward with respect to the inner mold 20 is respectively the same, furthermore the radial spacing RAA outward with respect to the outer mold 21 is respectively the same, and furthermore the radius R of the turns 16 with respect to the tube axis RA is the same. In addition, the axial spacing AA with respect to one another is respectively the same for all the turns 16.

The potting space 22 has been filled with a liquid plastic potting compound 32, so that the entire potting space 22 that has not been occupied by other structures (hoses 9*a*, 10*a*, directing bodies 23, contacting element 17) has been filled with the potting compound 32. The directing bodies 23 have ensured that the hoses 9*a*, 10*a* could not be displaced during the potting and during the subsequent curing of the potting compound 32, and, in particular, the spacings provided (for example RAI, RAA, AA for the respective turns 16), which are relevant for the breakdown strength, have been maintained with a high accuracy. The plastic of the potting compound 32 and the plastic of the directing bodies 23 have been selected to be the same, in particular, as a silicone material. In this way, creepage currents at the interfaces between directing bodies 23 and the potting compound 32 are minimized; this interface (insofar as it relates to the electrical properties) substantially vanishes after the curing of the potting compound 32.

The potted body 12 engages with a conical front end 29 into the recess 15 of the ceramic body 3 and is fastened thereto. The X-ray tube 1 can establish a good vacuum tightness and high-voltage strength with the ceramic body 3, and with the potted body 12 a good water-tightness and likewise a good high-voltage strength, in a compact space. The potting compound 32 is straightforward to handle and is maintenance-friendly (in particular, the cured potting compound 32 can no longer flow out of the potting space 22 and exhibits only little thermal expansion and aging, unlike an insulation oil). A long coolant column can be set up (path length of the supply line and discharge line), in particular, by using installation space axially and radially inside the ceramic body 3. The hoses 9*a*, 10*a* may for this purpose have a certain flexibility, although this can be defined because of the directing bodies 23 and can be placed with the required spacings in the potted body 12. Creepage paths can readily be set up with a large length (for instance between the potted body 12 and the ceramic body 3) or can be entirely avoided (by the same plastic for the directing bodies 23 and the potting compound 32). Overall, a straightforward and compact structure of the X-ray tube 1 is possible, voltage flashovers being reliably avoidable and the coolant flow being ensured in a defined and reliable way.

Figure 12:
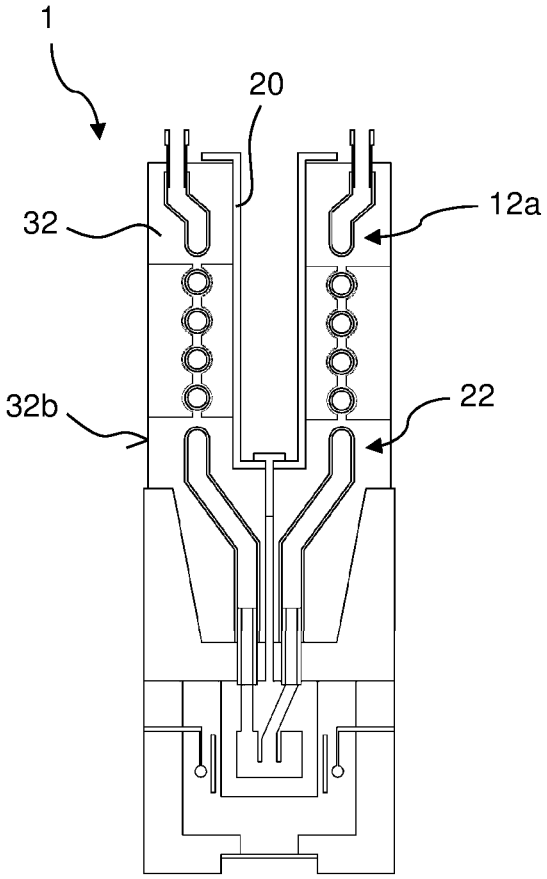
FIG. 12 shows the X-ray tube of FIG. 11 in a variant of the invention, after removal of the outer mold.

It should be noted that with the X-ray tube 1, the outer mold 21 may also (after the potting of the potting compound and its curing) be removed (not represented in detail in FIG. 1, but cf. FIG. 12 back).

Further embodiments of an X-ray tube 1 according to the invention, which correspond substantially to the embodiment of FIG. 1, will be explained in FIGS. 2 to 4. Only the substantial differences from the embodiment of FIG. 1 will respectively be explained.

Figure 2:
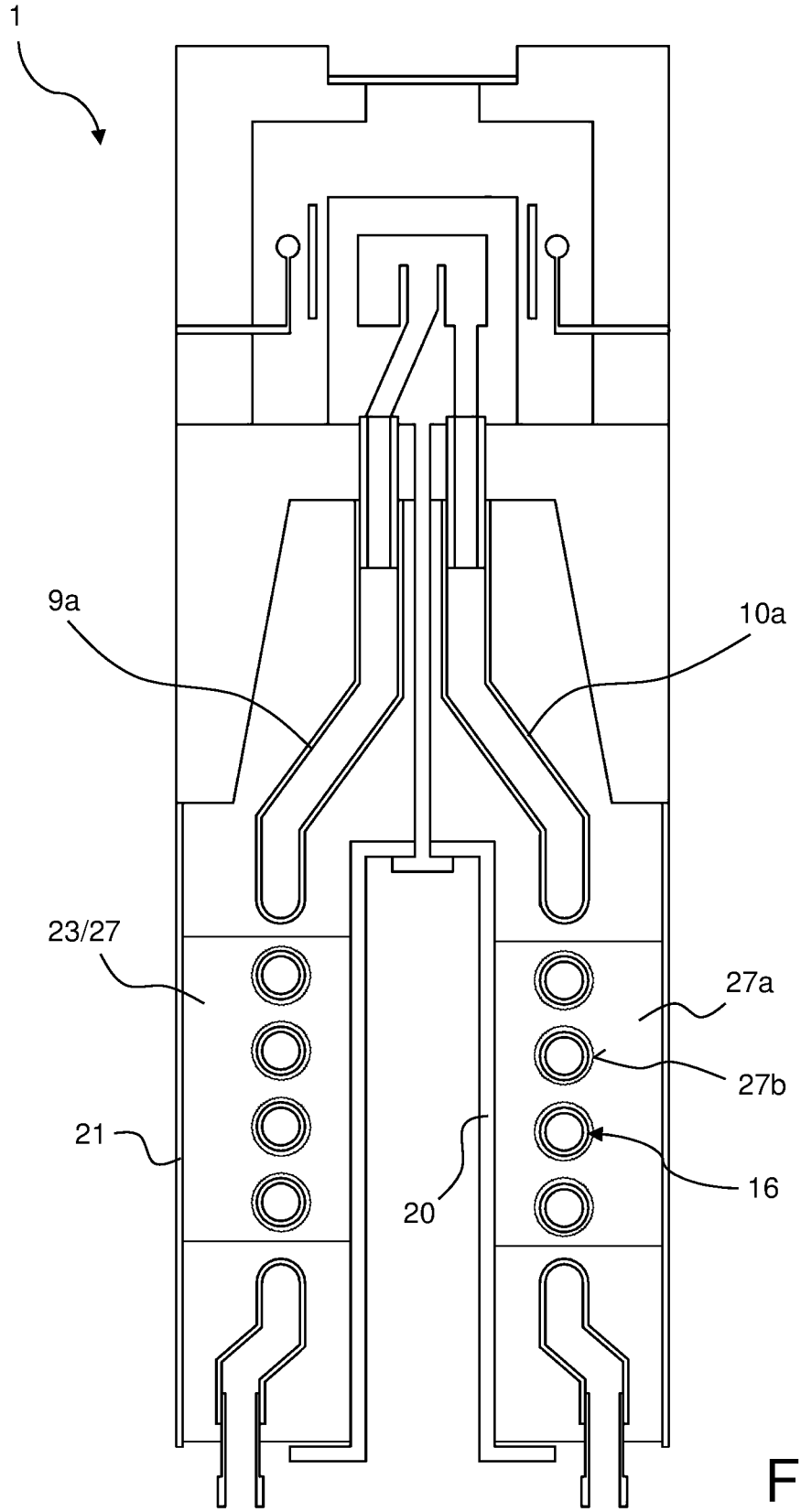
FIG. 2 shows a schematic longitudinal section of a second embodiment of an X-ray tube according to the invention, having perforated plates and turns of the hoses with a uniform radius.

FIG. 2 shows a second embodiment of an X-ray tube 1 according to the invention.

In this X-ray tube 1, the directing bodies 23 for the hoses 9*a*, 10*a* are configured as perforated plates 27. The perforated plates 27 are respectively formed by a plate 27*a* which contains a plurality of holes 27*b*. The turns 16 of the hoses 9*a*, 10*a* are fed through the holes 27*b*. The perforated plates 27 are typically arranged clamped between the inner mold 20 and the outer mold 21, in particular, during the potting and curing of the potting compound. As an alternative, the perforated plates 27 may also be aligned relative to the rest of the X-ray tube 1 by an external holder during the potting and curing.

Figure 3:
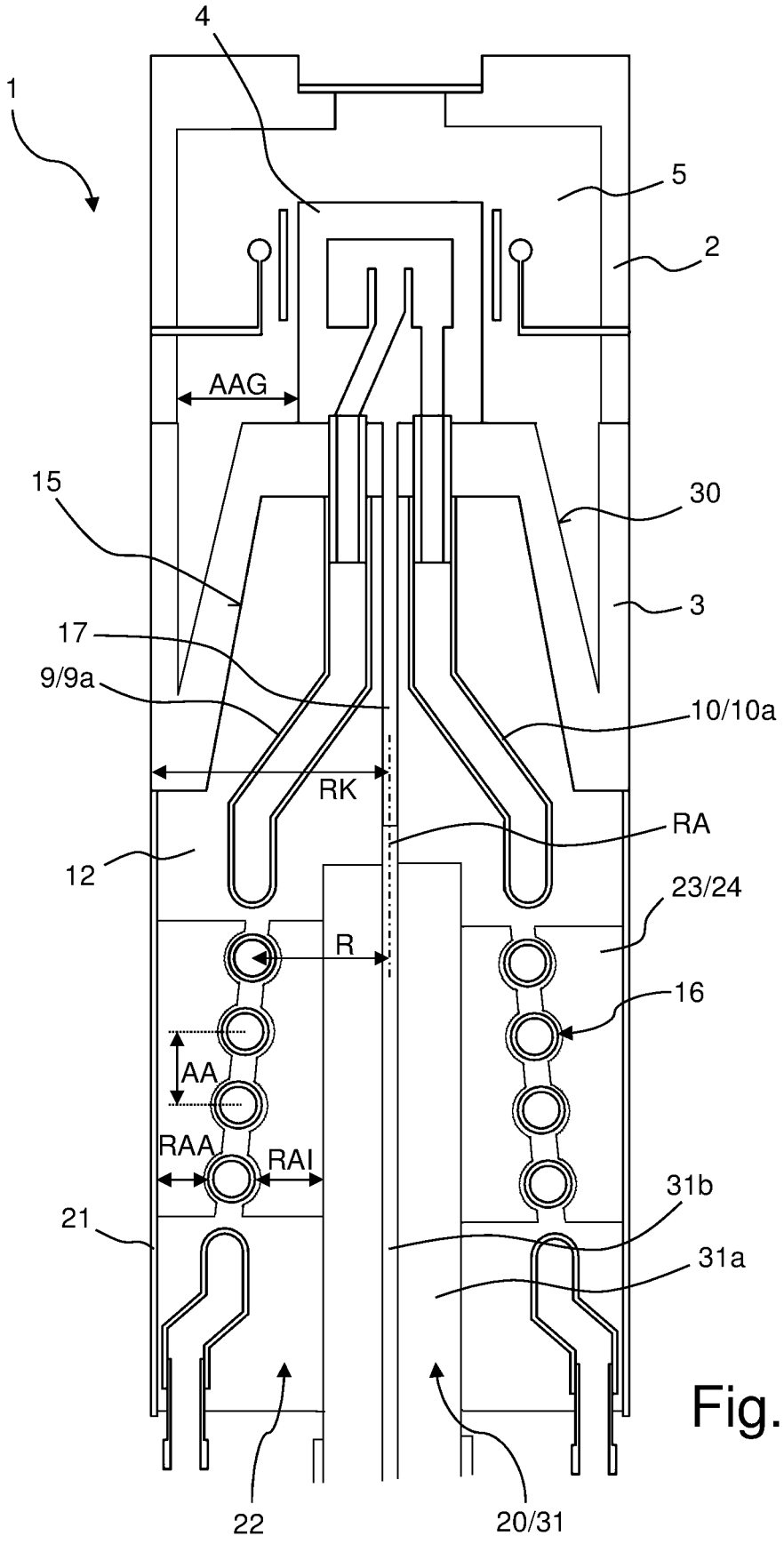
FIG. 3 shows a schematic longitudinal section of a third embodiment of an X-ray tube according to the invention, having grooved bars and turns of the hoses with a variable radius and a crown-shaped ceramic body.

FIG. 3 shows a third embodiment of an X-ray tube 1 according to the invention.

In this embodiment, the ceramic body 3 is formed with a circumferential indentation 30 on its front side facing toward the anode 4. This indentation 30 lies radially between the anode 4 and the cathode housing 2. A creepage path from the anode 4 to the outer side of the ceramic body 3 at the interface of the ceramic body 3 and the evacuated space 5 is thereby extended, and in particular is significantly longer than the spacing AAG between the anode 4 and the cathode housing 2. The circumferential indentation 30 appears approximately V-shaped (in other embodiments, also U-shaped, not represented) in longitudinal section on each side of the tube axis RA. In longitudinal section, the ceramic body 3 appears approximately W-shaped overall, or in a three-dimensional view approximately crown-shaped.

In the embodiment shown, a cable 31 which is formed by a plastic insulating sheath 31*a* and a metal core 31*b* is used as the inner mold 20. The core 31*b* is connected to the contacting element 17 so that the anode 4 can receive a high voltage via the core 31*b*. The insulating sheath 31*a* protrudes here into the potted body 12 in the axial direction (along the tube axis RA) beyond the turns 16. The sheath 31*a* is configured with a constant diameter, and the cable 31 is aligned along the tube axis RA. During the potting of the potting space 22, the cable 31 is potted permanently into the X-ray tube 1.

In this embodiment, corresponding directing bodies 23 furthermore ensure that the radial spacing RAA of the turns 16 of the hoses 9*a*, 10*a* outward with respect to the outer mold 21 decreases away from the anode 4. Conversely, the radial spacing RAI of the turns 16 of the hoses 9*a*, 10*a* inward with respect to the inner mold 20 increases away from the anode 4. In the supply line 9 and in the discharge line 10, the (local) potential is commensurately higher when a respective line section lies closer to the anode 4 (along the line path of the supply line 9 or of the discharge line 10). The effect achieved with this configuration is therefore that the radial spacing of line sections with a high potential from the outer mold 21 (in contact with the ground) is greater than in line sections with a low potential. Conversely, it also achieves the effect that the radial spacing of line sections with a low potential from the core 31*b* (which is at a high voltage) is greater than for line sections with a high potential. This prevents voltage flashovers and allows a particularly compact build of the X-ray tube 1 for a given high voltage.

The directing bodies 23 in this design are configured as wedge-shaped grooved bars 24, and the turns 16 have an equal axial spacing AA with respect to one another.

Figure 4:
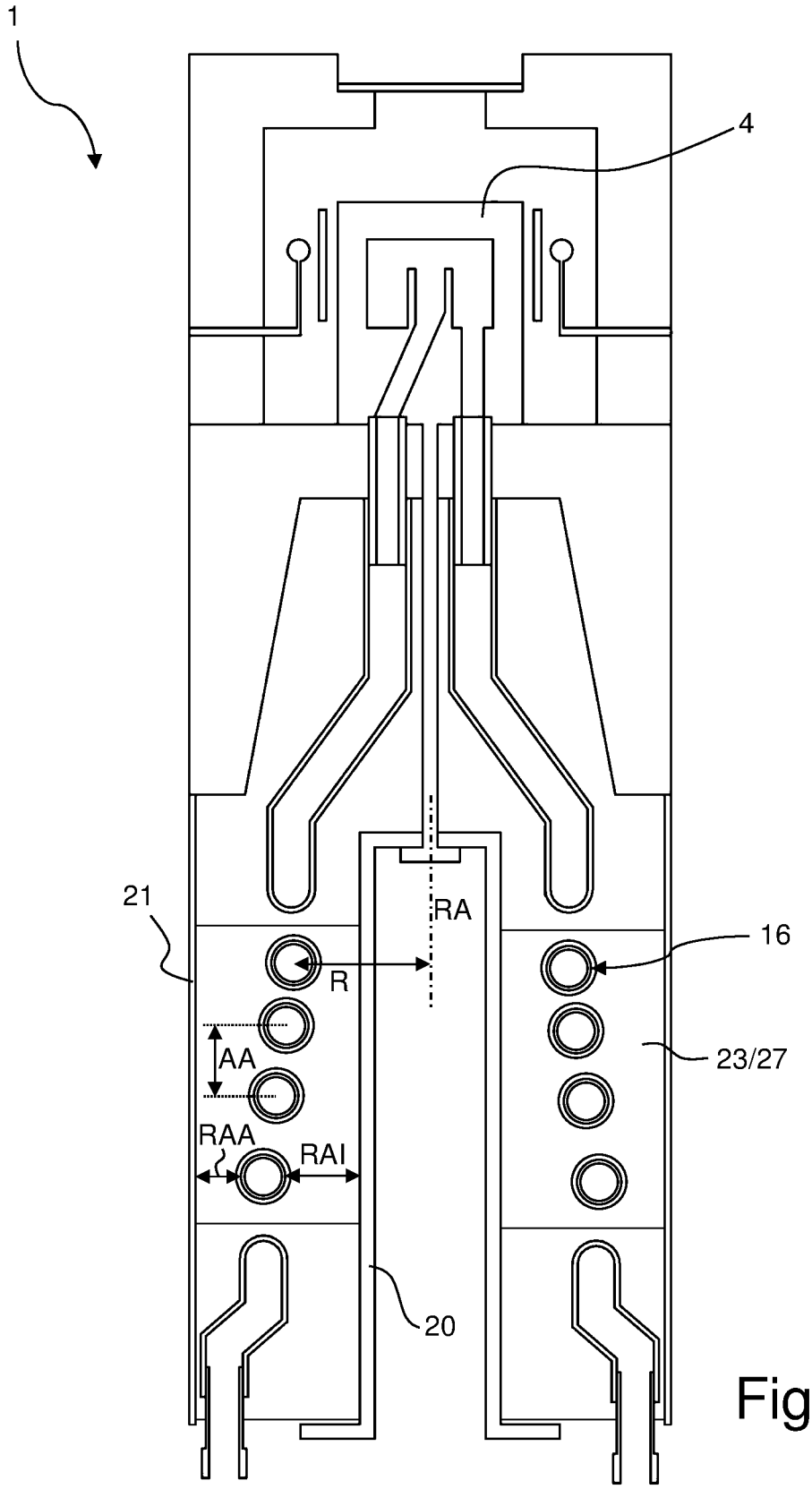
FIG. 4 shows a schematic longitudinal section of a fourth embodiment of an X-ray tube according to the invention, having perforated plates and turns of the hoses with a variable radius and variable axial spacing.

FIG. 4 shows a fourth embodiment of an X-ray tube 1 according to the invention.

In this embodiment, the directing bodies 23 are again configured in such a way that the radial spacing RAA of the turns 16 of the hoses 9*a*, 10*a* outward with respect to the outer mold 21 decreases away from the anode 4. Conversely, the radial spacing RAI of the turns 16 of the hoses 9*a*, 10*a* inward with respect to the inner mold 20 increases away from the anode 4. In addition, it is provided here that the axial spacing AA of neighboring turns 16 increases away from the anode 4. Because of the increase in the radii R of the respective turns 16 in the direction axially away from the anode 4, there is a higher voltage drop per turn 16 for turns 16 which are further away from the anode 4 than for turns 16 which lie closer to the anode 4. By the larger axial spacings AA for the turns 16 which lie further away from the anode 4, voltage flashovers between axially neighboring turns 16 can therefore be prevented and a more compact build of the X-ray tube 1 can be achieved.

FIGS. 5 to 8 show schematic cross sections through X-ray tubes according to the invention perpendicularly to the respective tube axis RA in various embodiments, respectively in the region of the turns 16 and the directing bodies 23. In this case, the arrangement of angular positions at which the respective directing bodies 23 may advantageously be arranged in the potting space 22 between the outer mold 21 and the inner mold 20 is illustrated by way of example. The location or the projection of the hoses 9*a*, 10*a* is respectively represented by dashes.

Figure 5:
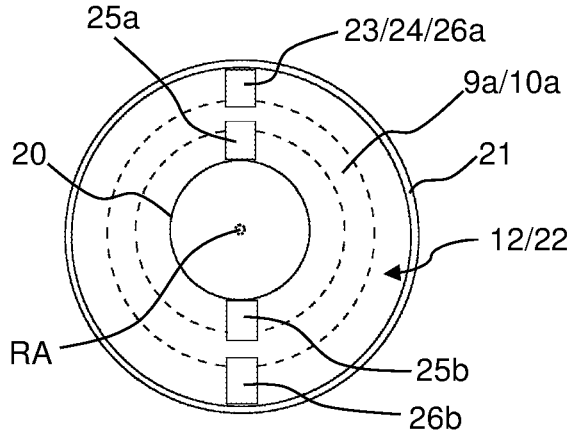
FIG. 5 shows a schematic cross section through an X-ray tube according to the invention, having directing bodies at angular positions with a rotationally symmetrical arrangement of the angular positions, with two inner grooved bars and two outer grooved bars opposing one another.

In the embodiment of FIG. 5, the directing bodies 23 are configured as grooved bars 24, two (N=2) inner grooved bars 25*a*, 25*b* and two (N=2) outer grooved bars 26*a*, 26*b* being provided. An inner grooved bar 25*a*, 25*b* and an outer grooved bar 26*a*, 26*b* respectively oppose one another and clamp the hoses 9*a*, 10*a* between them. The inner grooved bars 25*a*, 25*b* are supported on the inner mold 20. The outer grooved bars 26*a*, 26*b* are supported on the outer mold 21. The angular positions of the two inner grooved bars 25*a*, 25*b* are offset by 180° with respect to one another, and the angular positions of the outer grooved bars 26*a*, 26*b* are offset by 180° with respect to one another. The arrangement of the angular positions of the directing bodies 23 has 2-fold rotational symmetry here.

Figure 6:
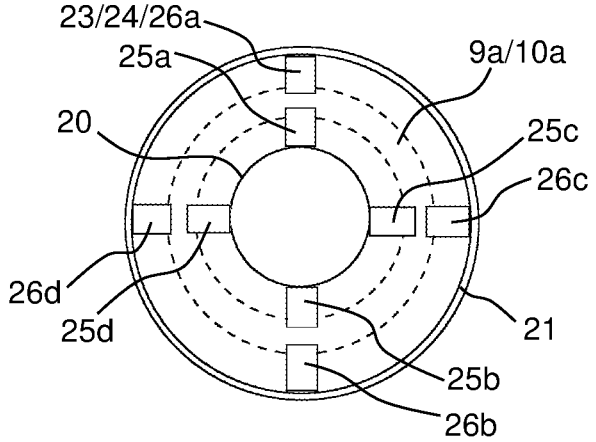
FIG. 6 shows a schematic cross section through an X-ray tube according to the invention, having directing bodies at angular positions with a rotationally symmetrical arrangement of the angular positions, with four inner grooved bars and four outer grooved bars opposing one another.

In the embodiment of FIG. 6, the directing bodies 23 are likewise configured as grooved bars 24, four (N=4) inner grooved bars 25*a*, 25*b*, 25*c*, 25*d* and four (N=4) outer grooved bars 26*a*, 26*b*, 26*c*, 26*d* being provided. An inner grooved bar 25*a*, 25*b*, 25*c*, 25*d* and an outer grooved bar 26*a*, 26*b*, 26*c*, 26*d* respectively oppose one another and clamp the hoses 9*a*, 10*a* between them. The inner grooved bars 25*a*, 25*b*, 25*c*, 25*d* are supported on the inner mold 20. The outer grooved bars 26*a*, 26*b*, 26*c*, 26*d* are supported on the outer mold 21. The angular positions of the four inner grooved bars 25*a*, 25*b*, 25*c*, 25*d* are offset by 90° with respect to one another, and the angular positions of the outer grooved bars 26*a*, 26*b*, 26*c*, 26*d* are offset by 90° with respect to one another. The arrangement of the angular positions of the directing bodies 23 has 4-fold rotational symmetry here.

Figure 7:
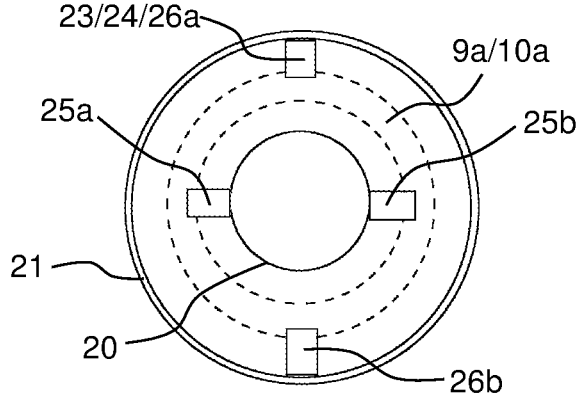
FIG. 7 shows a schematic cross section through an X-ray tube according to the invention, having directing bodies at angular positions with a rotationally symmetrical arrangement of the angular positions, with two inner grooved bars being arranged offset by 90° with respect to two outer grooved bars.

In the embodiment of FIG. 7, the directing bodies 23 are again configured as grooved bars 24, two (N=2) inner grooved bars 25*a*, 25*b* and two (N=2) outer grooved bars 26*a*, 26*b* being provided. The inner grooved bars 25*a*, 25*b* are supported on the inner mold 20. The outer grooved bars 26*a*, 26*b* are supported on the outer mold 21. The angular positions of the two inner grooved bars 25*a*, 25*b* are offset by 180° with respect to one another, and the angular positions of the outer grooved bars 26*a*, 26*b* are offset by 180° with respect to one another. The angular positions of the inner grooved bars 25*a*, 25*b* are in this case offset by 90° relative to the angular positions of the outer grooved bars 26*a*, 26*b*. The hoses 9*a*, 10*a* are also held clamped by the directing bodies 23 here; in this embodiment, the hoses 9*a*, 10*a* should have a certain minimum stiffness against radial compression and stretching (against "oval deformation"), so that a good clamping action of the directing bodies 23 occurs. The arrangement of the angular positions of the directing bodies 23 has 2-fold rotational symmetry here.

It should be noted that the grooved bars 24 may extend parallel to the tube axis RA, in which case the grooves must be fitted into the respective bar with an inclination corresponding to the pitch of the double helix of the hoses 9*a*, 10*a*. As an alternative, the grooved bars 24 may also extend with grooves fitted perpendicularly to their extent direction, and then be arranged with an inclination with respect to the tube axis RA in the potting space 12 which corresponds to the pitch of the hoses 9*a*, 10*a*. It should furthermore be noted that the inner grooved bars 25*a*-25*d* may be supported not only on the inner mold 20 but, as an alternative or in addition, also on one another, in particular with the inner grooved bars 25*a*-25*d* forming partial shells (in particular half-shells or quarter-shells) which engage around the inner mold (not represented in detail here).

Figure 8:
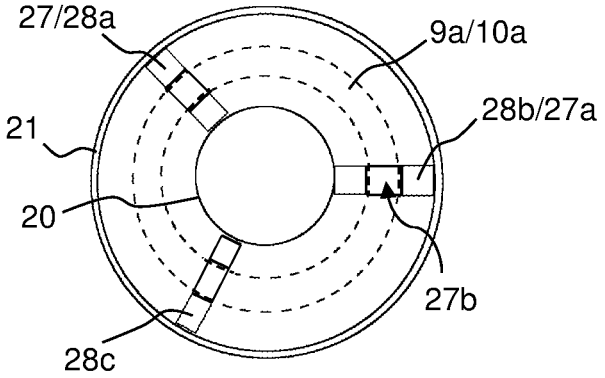
FIG. 8 shows a schematic cross section through an X-ray tube according to the invention, having directing bodies at angular positions with a rotationally symmetrical arrangement of the angular positions, with three perforated plates being arranged offset by 120° with respect to one another.

In the embodiment of FIG. 8, the directing bodies 23 are configured as perforated plates 27, three (N=3) perforated plates 28*a*, 28*b*, 28*c* being provided, the angular positions of which are offset by 120° with respect to one another. The perforated plates 27 are respectively supported with their plates 27*a* (or the lateral edges thereof) both on the inner mold 20 and on the outer mold 21. The hoses 9*a*, 10*a* are fed through the holes 27*b* of the plates 27*a*. The arrangement of the angular positions of the directing bodies 23 has 3-fold rotational symmetry here.

Figure 9:
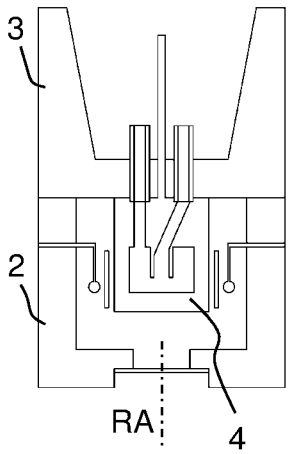
FIG. 9 shows a schematic longitudinal section of a partially manufactured X-ray tube, having a cathode housing and a ceramic body, which is manufactured according to the invention to form a complete X-ray tube.
Figure 10:
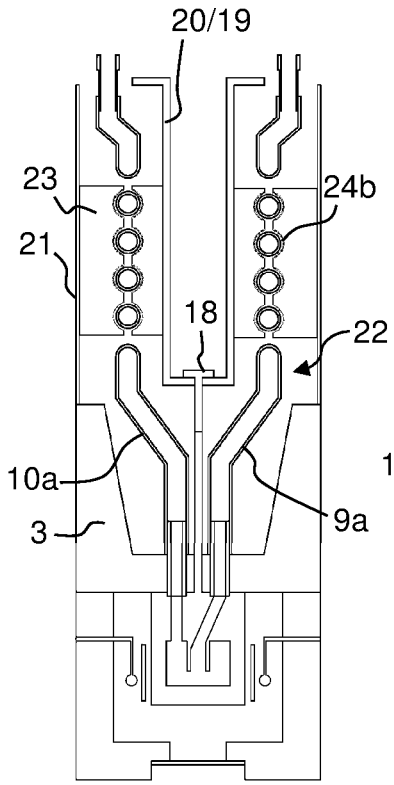
FIG. 10 shows the partially manufactured X-ray tube of FIG. 9, having a positioned inner mold and outer mold which form a potting space, having positioned directing bodies and positioned hoses.
Figure 11:
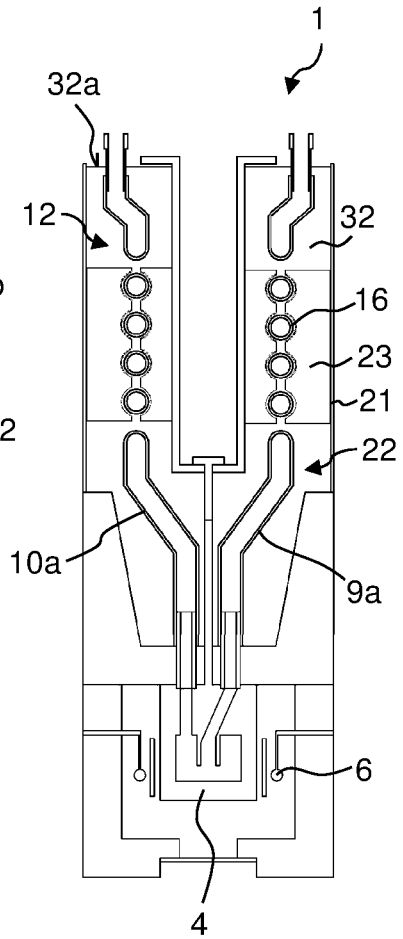
FIG. 11 shows the X-ray tube of FIG. 10, now fully completed, the potting space being filled with a potting compound.

FIGS. 9 to 11 schematically illustrate the sequence of the manufacture of an X-ray tube 1 according to the invention. By way of example, an X-ray tube 1 as described in FIG. 1 is manufactured. Longitudinal sections along the tube axis RA are respectively represented schematically.

The manufacture begins with the provision of a partially manufactured X-ray tube 100, essentially comprising the ceramic body 3 on which the anode 4 and the cathode housing 2 are already fastened, cf. FIG. 9. The cathode housing 2 is in this case directed downward.

The potting space 22 is then prepared by (in principle in any desired order): putting the outer mold 21 on the ceramic body 3; placing the inner mold 20 (here a bush 19 including a terminal pole 18) inside the outer mold 21; and arranging the directing bodies 23 and the hoses 9*a*, 10*a* in the region between the inner mold 20 and the outer mold 21. The state then reached is shown in FIG. 10. The hoses 9*a*, 10*a* are held in position by the directing bodies 23, here the grooves 24*b*. The potting space 22 is open upward.

The potting space 22 is then filled with a curable liquid potting compound 32 made of plastic, which for example is selected as a silicone. The potting compound 32 is most simply poured into the potting space 22 from above. The liquid potting compound 32 is distributed throughout the entire available potting space 22 up to a surface 32*a* of the potting compound 32. The potting compound 32 enters in particular, between the turns 16 and the inner mold 20, between the turns 16 and the outer mold 21, and axially between neighboring turns 16. The potting compound 32 thus encloses the hoses 9*a*, 10*a* as well as the directing bodies 23. The filled state of the potting space 22 is shown in FIG. 11. The liquid potting compound 32 is then cured; for the curing, typically a certain time is waited and/or heat is applied. After the curing of the potting compound 32, the potted body 12 and the X-ray tube 1 overall are completed. In this variant, the outer mold 21 remains on the X-ray tube 1; the outer mold 21 may be clad with lead foil (not represented) for grounding and radiation protection. With an anode 4 cooled by means of a coolant, for example deionized water, in the hoses 9*a*, 10*a* and a high voltage applied between the anode 4 and the heated hot cathode 6, X-radiation may then be generated by means of the X-ray tube 1 during operation.

In another variant, starting from the X-ray tube shown in FIG. 11, the outer mold of the potted body is removed after the curing of the potting compound 32; a corresponding X-ray tube 1 with a removed outer mold is represented in FIG. 12. Of the potted body, a residual potted body 12*a*, which is formed essentially by the potting space 22 filled with cured potting compound 32 (including the encapsulated directing body or bodies and the encapsulated hose sections) and the inner mold 20, then remains in the X-ray tube 1. A (radially outer) side face 32*b* of the cured potting compound 32, or of the filled potting space 22, is correspondingly exposed; this side face 32*b* may be clad with a lead foil (not represented) for grounding and radiation protection. In this variant, the outer mold may be used several times (it is then usually configured in multiple parts for radial mold release and arranged permanently on a potting station, not represented). The X-ray tube 1 shown in FIG. 12 may be used in the same way as the X-ray tube shown in FIG. 11 for the generation of X-radiation during operation.

LIST OF REFERENCE SIGNS

1 X-ray tube
2 cathode housing
3 ceramic body
4 anode
4*a* upper side of the anode ("target")
4*b* anode channels for coolant (in the anode body)
5 evacuated space
6 hot cathode
7*a* ground terminal
7*b* current terminal (for heating current)
8 shield
9 supply line
9*a* hose of the supply line
9*b* coolant connection (supply line)
10 discharge line
10*a* hose of the discharge line
10*b* coolant connection (discharge line)
11 insulation body
12 potted body
12*a* rest of the potted body
13 radiation exit window, here beryllium window
14*a* tubelet of the supply line
14*b* tubelet of the discharge line
15 recess
16 turn
17 contacting element
18 terminal pole
19 bush
20 inner mold
21 outer mold
22 potting space
23 directing body
24 grooved bar
24*a* bar
24*b* groove
25*a*-25*d* inner grooved bar
26*a*-26*d* outer grooved bar
27 perforated plate
27*a* plate
27*b* hole
28*a*-28*d* perforated plates
29 conical front end of the potted body
30 circumferential indentation
31 cable
31*a* sheath
31*b* core
32 potting compound

32*a* surface (potting compound)
32*b* side face (potting compound)
100 partially manufactured X-ray tube
AA axial spacing
AAG radial spacing of the anode and the cathode housing
AEK axial extent of the ceramic body
GRR largest radius of the recess
KRR smallest radius of the recess
R radius of the turn
RA tube axis
RK outer radius of the ceramic body on the rear side
RAA radial spacing outward
RAI radial spacing inward
TR axial depth of the recess

LIST OF REFERENCES

[1] WO 2008/148426 A1
[2] DE 10 2017 217 181 B3
[3] U.S. Pat. No. 10,714,300 B2
[4] Company brochure "OEG-92J Industrial X-Ray tube", Version 2021, of the Varex Imaging Corporation, Salt Lake City, Utah 84104, USA.
[5] DE 10 2008 017 153 A1
[6] US 2012/0 076 278 A1
[7] JP 2015-232 944 A

What is claimed is:

1. An X-ray tube, comprising:

a cathode housing having an X-ray radiation exit window, a cooled anode, a cathode, an insulation body configured for electrical insulation of a high-voltage potential of the anode, a supply line configured for coolant to the anode, and a discharge line configured for coolant from the anode;

the supply line and the discharge line respectively comprising a plurality of turns in the insulation body;

wherein the insulation body comprises a ceramic body and a potted body;

the anode and the cathode housing being fastened on the ceramic body and the potted body being fastened on the ceramic body;

wherein the potted body comprises an inner mold and, at least temporarily during the production of the X-ray tube, an outer mold;

wherein the supply line and the discharge line are respectively configured with a hose, which forms the plurality of turns, in a potting space between the outer mold and the inner mold;

wherein at least one plastic directing body, by which the hoses are aligned in the potting space, is arranged in the potting space, wherein the turns of the hoses are respectively separated from the outer mold and the inner mold; and wherein the potting space is filled with a plastic potting compound in a cured state, wherein the intermediate spaces between the turns on the one hand and the outer mold and the inner mold on the other hand are occupied by the plastic of the at least one directing body and/or the plastic of the potting compound.

2. The X-ray tube as claimed in claim 1, wherein with the at least one directing body, the hoses are furthermore aligned in the potting space, wherein the turns of the hoses are also separated from one another, and wherein the potting space is furthermore filled with the potting compound, wherein the intermediate spaces between the turns are also occupied by the plastic of the at least one directing body and/or the plastic of the potting compound.

3. The X-ray tube as claimed in claim 1, wherein the ceramic body has a circumferential indentation between the cathode housing and the anode on a front side facing toward the anode, and wherein the ceramic body has a central recess on a rear side of the ceramic body facing toward the potted body.

4. The X-ray tube as claimed in claim 3, wherein the hoses are arranged partially in a region of the central recess of the ceramic body, in particular with in each case at least one half-turn of the hoses and/or at least 10% of the length of the hoses being arranged in the central recess of the ceramic body.

5. The X-ray tube as claimed in claim 1, wherein the inner mold is configured as a bush for a high-voltage plug for connection to the anode.

6. The X-ray tube as claimed in claim 1, wherein the inner mold is configured as a cable which comprises an insulating sheath and a core running in the sheath, to which the anode is connected.

7. The X-ray tube as claimed in claim 1, wherein the at least one directing body and the potting compound consist of the same plastic.

8. The X-ray tube as claimed in claim 7, wherein the plastic of the potting compound comprises a silicone or an epoxy resin or a polyurethane.

9. The X-ray tube as claimed in claim 1, wherein a plurality of directing bodies is arranged in the potting space, in particular with the directing bodies in each case being arranged clamped between the inner mold and the outer mold and/or between the hoses on the one hand and the inner mold or the outer mold on the other hand.

10. The X-ray tube as claimed in claim 9, wherein the directing bodies are arranged at angular positions in a respective section plane perpendicular to a tube axis (RA) of the X-ray tube, the angular positions forming a rotationally symmetrical arrangement with respect to the tube axis (RA).

11. The X-ray tube as claimed in claim 10, wherein N directing bodies support the hoses toward the inner mold and N directing bodies support the hoses toward the outer mold, and the rotationally symmetrical arrangement of the angular positions has N-fold symmetry, where N is a natural number with $N \geq 2$.

12. The X-ray tube as claimed in claim 11, wherein the N directing bodies which support the hoses toward the inner mold and the N directing bodies which support the hoses toward the outer mold are arranged with respect to the tube axis (RA) in a respective section plane at identical angular positions, or at angular positions offset by $360°/(2*N)$ with respect to one another.

13. The X-ray tube as claimed claim 1, wherein one or more directing bodies of the at least one directing body are configured as a perforated plate comprising a plate and a plurality of holes in the plate, through which the hoses are guided, in particular with a respective perforated plate being arranged clamped between the inner mold and the outer mold.

14. The X-ray tube as claimed in claim 1, wherein one or more directing bodies of the at least one directing body are configured as a grooved bar comprising a bar and a plurality of grooves, in particular semicircular grooves, into which the hoses are placed, in particular, with a respective grooved bar being arranged clamped between the hoses on the one hand and the inner mold or the outer mold on the other hand.

15. The X-ray tube as claimed in claim 14, wherein grooved bars which support hoses toward the inner mold and grooved bars which support hoses toward the outer mold are respectively arranged lying opposite one another pairwise.

16. The X-ray tube as claimed claim 1, wherein the turns of the hoses are wound around a tube axis (RA) and are sequenced along a tube axis (RA).

17. The X-ray tube as claimed in claim 16, wherein the turns have a constant radius (R) with respect to the tube axis (RA).

18. The x-ray tube according to claim 17, with the outer mold and the inner mold being configured substantially in the form of the lateral surface of a cylinder and coaxially with respect to the tube axis (RA) and the turns having a constant radial spacing (RAA) with respect to the outer mold and furthermore the turns have a constant radial spacing (RAI) with respect to the inner mold.

19. The X-ray tube as claimed in claim 17, wherein the turns have a constant spacing (AA) with respect to one another in the axial direction.

20. The X-ray tube as claimed in claim 16, wherein the turns have a radius (R) with respect to the tube axis (RA) which increases away from the anode.

21. The X-ray tube as claimed in claim 20, with the outer mold and the inner mold being configured substantially in the form of the lateral surface of a cylinder and coaxially with respect to the tube axis (RA) and the turns having a radial spacing (RAA) with respect to the outer mold which decreases away from the anode and furthermore the turns having a radial spacing (RAI) with respect to the inner mold which increases away from the anode.

22. The X-ray tube as claimed in claim 20, wherein the turns have a constant axial spacing (AA) with respect to one another or an axial spacing (AA) with respect to one another which increases away from the anode.

23. The X-ray tube as claimed in claim 1, wherein after the production of the X-ray tube, the outer mold remains on the rest of the potted body.

24. The X-ray tube as claimed in claim 1, wherein after the production of the X-ray tube, the outer mold is removed from the rest of the potted body.

25. The X-ray tube as claimed in claim 1, wherein the cathode is a hot cathode.

26. A method for producing the X-ray tube as claimed in claim 1, the method comprising the steps of:

a) in order to set up the potting space, arranging the outer mold in a sealing manner on a rear side of the ceramic body facing away from the anode and arranging the inner mold in front of the rear side of the ceramic body, and arranging the at least one plastic directing body and the hoses in the potting space between the inner mold and the outer mold, with the at least one directing body aligning the hoses in the potting space, wherein the turns of the hoses are respectively separated from the outer mold and the inner mold;

b) filling the potting space with the plastic potting compound in a liquid state, wherein the intermediate spaces between the turns on the one hand and the outer mold and the inner mold on the other hand are occupied by the plastic of the at least one directing body and/or the plastic of the potting compound; and c) curing the plastic potting compound.

27. The method as claimed in claim 26, wherein the X-ray tube is produced, wherein the outer mold is remaining on the rest of the potted body after step c).

28. The method as claimed in claim 26, wherein the X-ray tube is produced comprising a further step d) of removing the outer mold from the rest of the potted body.

29. The method as claimed in claim 26, wherein the turns of the hoses are also separated from one another, and wherein the intermediate spaces between the turns are also occupied by the plastic of the at least one directing body and/or the plastic of the potting compound when filling the potting space with the plastic potting compound in the liquid state.

* * * * *